United States Patent [19]

Murray et al.

[11] 4,110,947

[45] Sep. 5, 1978

[54] STORAGE TANK INSTALLATION

[75] Inventors: James T. Murray; Walter T. Gorman, both of Brooklyn, N.Y.

[73] Assignee: Murgor Electric Company, Inc., Brooklyn, N.Y.

[21] Appl. No.: 859,013

[22] Filed: Dec. 9, 1977

[51] Int. Cl.[2] ..... B65D 25/00

[52] U.S. Cl. ..... 52/249; 52/742; 405/54; 220/18

[58] Field of Search ..... 61/1 R, 0.5; 52/169.7, 52/169.8, 169.1, 169.2, 169.3, 742, 249; 220/9 R, 9 A, 18; 137/236, 343, 386, 561

[56] References Cited

U.S. PATENT DOCUMENTS

| | | | |
|---|---|---|---|
| 2,912,004 | 11/1959 | Meredew | 137/561 R |
| 2,946,475 | 7/1960 | Rockelman | 220/18 |
| 3,092,933 | 6/1963 | Closner et al. | 220/18 X |
| 3,288,321 | 11/1966 | Wokas | 220/18 |
| 3,326,011 | 6/1967 | Sparling | 61/0.5 X |
| 3,352,116 | 11/1967 | Waterman | 52/249 X |
| 3,465,527 | 9/1969 | Rohmer | 61/0.5 |
| 3,477,606 | 11/1969 | Schwendtner | 220/9 A |
| 3,924,773 | 12/1975 | Wilkinson | 220/9 A X |

*Primary Examiner*—Dennis L. Taylor

[57] ABSTRACT

An underground storage tank installation. The excavation is to a predetermined depth to permit placement of a storage tank of desired size therein below ground level. At least a pair of opposing side walls of the excavation are sloped to minimize the danger of collapse. The excavation is provided with a base layer of footing material by appropriate backfill and a double shell storage tank is rested on the base layer in the excavation. Double shell piping conduits and a leak detector is installed between the shell and ground level. Backfill material is placed into the excavation to cover the tank and piping and leak detector structure to a height adjacent ground level. A solid slab is positioned over the tank and the backfill layers with appropriate apertures to permit access to the underground piping conduits and the leak detector. The excavation, backfilling, placement of the tank, piping and detector and pouring of the slab are accomplished without the necessity of personnel entering the excavation.

15 Claims, 2 Drawing Figures

STORAGE TANK INSTALLATION

BACKGROUND OF THE INVENTION

It is common practice today to store many gases liquids or vapors such as gasoline in underground storage tanks for safety reasons as well as space saving reasons. The most common type of installation presently in use involves a single shell steel tank which must be encased in 12 inches of concrete.

The installation procedure is rather complex, time consuming and could be dangerous to the workers during the actual installation procedures. With a common type size tank, such as for storage of gasoline, the contractor excavates to a depth of approximately 10 feet by using a backhoe. The excavation is made rectangular in shape. He must have two or three laborers enter the excavation and install 4 foot by 8 foot wood shoring around the sides of the excavation to prevent collapse and to make a form for pouring a concrete footing. The contractor then pours a 12 inch concrete base and the laborers must again enter the excavation to evenly distribute the concrete.

After the concrete hardens, the contractor must lift the tank into place in the excavation and install piping. The tank and piping are encased in 12 inches of poured concrete up to the level of the top of the tank after successfully testing the tank and piping hydrostatically, at 30 psi for 30 minutes. Load bearing blocks are then placed around the tank perimeter, clean sand is placed over the tank and a reinforced concrete top slab is poured to grade level.

There are certain difficulties and potential hazards that can develop from an installation of the above type. For example, the excavation could collapse with or without shoring causing injury or death to laborers in the excavation. Furthermore, the tanks are single shell steel tanks which ultimately corrode and allow their contents to leak out resulting in an extremely dangerous condition. Fuels have been known to migrate underground and enter sewer lines, basements, underground utility lines, contaminate reservoirs and cause explosions. Also, during concrete encasement, the tank can float causing damage to the installation. Finally, it should also be kept in mind that the excavation remains open until the piping is completed and arrangements are made to encase the tank. This may take two weeks time during which pedestrians, children, workers, or even vehicles can fall into the excavation. In its entirety, the above manner of installation requires approximately four weeks to complete the work.

It is readily apparent from the potential disadvantages and difficulties encountered with the system in use that there is considerable room for improvement in the field of underground storage tank installation.

SUMMARY OF THE INVENTION

With the above background in mind, it is among the primary objectives of the present invention to provide an improved method of underground storage tank installation with the following advantages over the above discussed type of installation. First, no workers need enter the excavation, the sides of the excavation are provided with a 45° slope to minimize the possibility of collapse. The outer shell of a double shell tank catches any liquid which leaks from the inner shell and triggers an alarm of a leak detecting device which is installed between the inner and outer shells of the tank. This will signal any defect in the interior shell so that repairs can be made before any serious problem begins. In the present system, the tank is continuously monitored for leakage both by the detecting device for detecting leakage from the inner shell and by the application of air pressure to the space between the tanks whereby the air pressure is monitored so that any defect in the outer shell of the tank indicating a reduction in pressure between the shells will be detected as well. Naturally the space between the walls can be pressurized by fluids other than air and the pressure loss detected to indicate leakage.

The result of this system is a low cost installation both in terms of time and materials and greater safety and security to the general public especially where the tanks are located in residential communities. The time for installation would be cut approximately in half when compared with the time required for the type of installation presently in use and described above.

More specifically, the proposed method of installation is to excavate to a depth of 10 feet for a common size tank and backfill with 12 inches of peastone gravel for footing. The sides of the excavation are sloped at 45° to minimize the possibility of collapse of the excavation. A double shell tank is placed into the excavation and encased in peastone a minimum of 12 inches on all sides. The digging of the excavation and the installation of the tank and peastone can be performed in a single day. Double shell piping and backfill with peastone over the tank and piping trenches can then be installed in the excavation and a poured reinforced concrete top slab is mounted over the tank with appropriate apertures for leak monitoring purposes as well as for access to the contents of the tank.

More generally, the procedure for installing types of the kind under consideration involves excavation to a predetermined depth sufficient for placement of the selected storage tank of desired size therein below ground level. At least one pair of the opposing side walls of the excavation are sloped to minimize the danger of collapse. The excavation is backfilled to form a base layer of footing material. A double shell storage tank is then placed into the excavation resting on the base layer. Double shell piping conduits and leak monitoring means are installed between the shell and ground level. Covering material is then backfilled over the tank and piping to a height adjacent ground level. A solid slab is poured over the tank and backfill layer without closing access to the underground piping conduits. Finally, all excavating, backfilling, placing of the tank, piping and leak detecting means as well as pouring of the top slab can be accomplished without the necessity of personnel entering the excavation.

With the above objectives among others in mind, reference is made to the attached drawings.

DESCRIPTION OF THE PREFERRED EMBODIMENT

Figure 1:
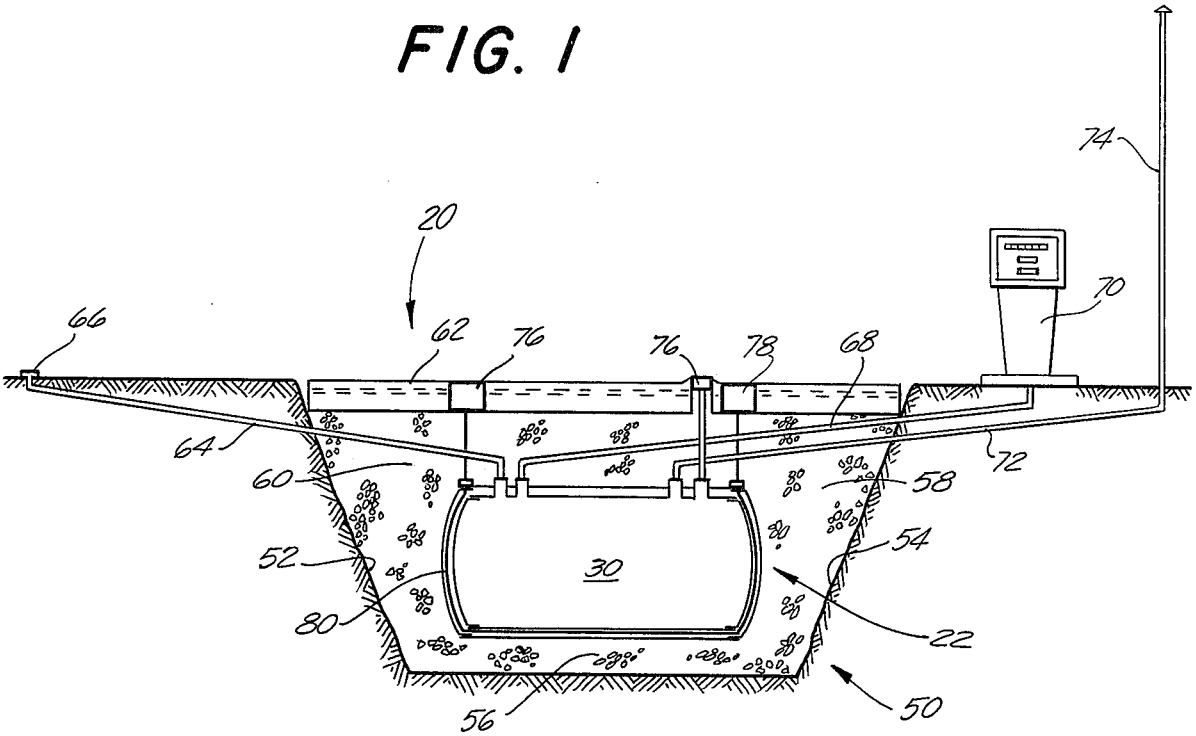
FIG. 1 is a sectional end view of an installation of the invention.
Figure 2:
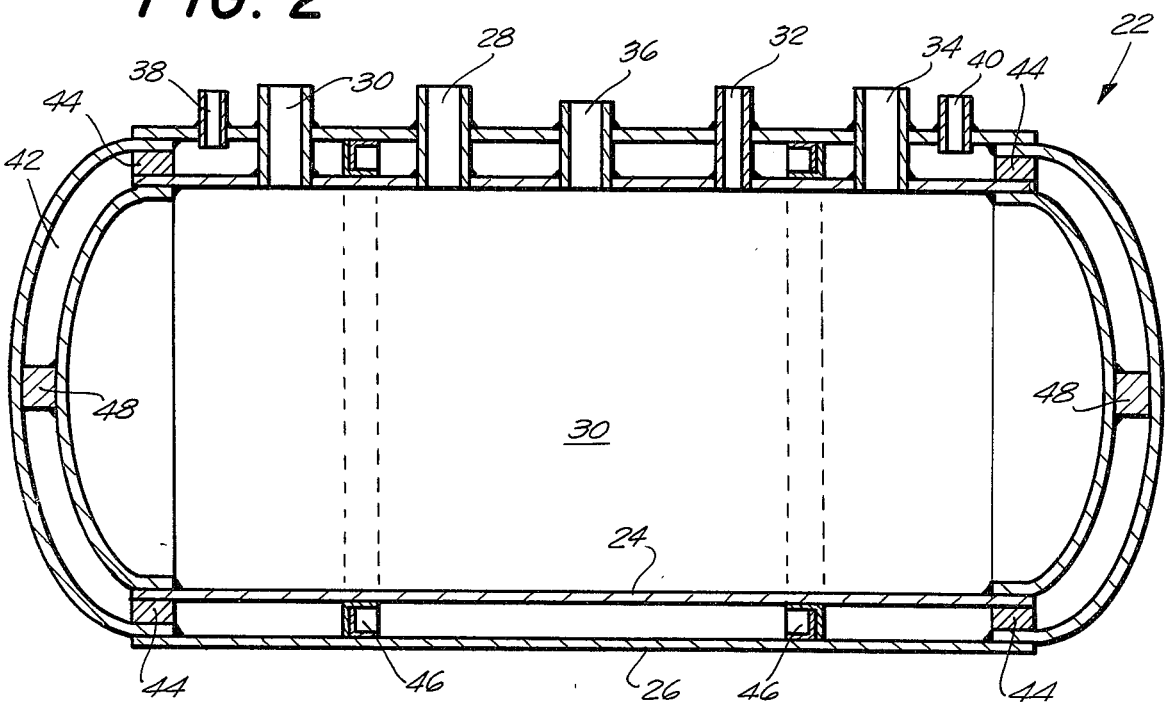
FIG. 2 is an enlarged sectional elevation view of a double wall storage tank used in the installation of the invention.

Installation 20 of a typical underground storage tank is depicted in FIG. 1. FIG. 2 shows an enlarged view of the type of tank 22 utilized in the installation. The tank 22 is a conventional double walled tank including an inner shell 24 and an outer shell 26 spaced from the inner shell and in surrounding relationship with respect thereto. Various access pipes and openings are located in the top side of tank 22. These conduits include a pump vent 28, a fill vent 30, an air vent 32, a gauge vent 34 and a spare conduit 36 which can be capped. All of the conduits communicate directly with the interior chamber 30 of the inner shell 24. Other conduits in the top of tank 22 are a pair of inspection conduits or vents 38 and 40 which communicate with the space 42 between the inner shell 24 and the outer shell 26 for the purpose of monitoring pressure conditions and potential leakage in that space.

Other details of tank construction include the provision of appropriate spacers 44 positioned at predetermined locations about the circumferential arrangement between the inner and outer shells to avoid undesirable deformation of the double shell arrangement and possible interference with the required spacing over the entire area of the double wall arrangement. A pair of L rings welded into a C-shaped configuration are provided for assistance in bonding shells 24 and 26 together. Appropriate end supports 48 are also welded in position to interengage the two shells and provide support for the double walled arrangement. Both shells are formed by welding arcuate end pieces to cylindrical center pieces in a conventional manner. An example of a standard type typical storage tank as depicted in FIGS. 1 and 2 would include tubular portions of ¼ inch thick steel and arcuate end portions 5/16 inch thickness steel heads.

To accomplish the installation 20 of FIG. 1, an excavation 50 of the needed depth for tank 22 is dug in a conventional manner to a desired depth such as 10 feet. The excavation 50 is basically rectangular in shape with the exception of two opposing sloped side walls 52 and 54. These side walls are sloped to a desired degree, as shown approximately 45°, to minimize the possibility of collapse of the excavation. Excavation 50 is then backfilled with a base layer of footing material 56, for example, of peastone gravel or the conventional fill material. In the depicted embodiment, the layer is approximately 12 inches in depth.

Double shell tank 22 is then placed into the excavation and is encased, preferably immediately, with more fill material 58. Once again the preferred amount of fill surrounding the tank is approximately 12 inches on all sides. All of the above steps can be accomplished without difficulty within a single day.

Appropriate double shell piping as depicted and leak monitoring conduits are installed and then more fill material 60 is backfilled over the tank and piping trenches, thereby encasing the underground piping and double wall tank with fill material and substantially filling the excavation. A poured reinforced concrete top slab 62 is then positioned over the filled excavation to complete the installation 20.

The connections between tank 22 and surface elements are accomplished in the following manner. Fill vent 30 is connected by means of conduit 64 to a fill box 66 for filling tank 30 with the material to be stored. In the depicted embodiment, the material is a fuel material such as gasoline.

Pump vent 28 is used for interconnecting conduit 68 with a fuel pump 70 above ground. Vent 32 is connected by means of a vent pipe 72 to an above ground vent 74 to atmosphere for venting the interior 30 of the tank 22.

Opening 34 is used for permitting access of an above ground gauge 76 to measure the volume of the contents within the tank in a conventional manner.

A spare vent 36 is normally maintained in capped condition and is used only if an additional access is required to the interior of the tank.

The leak monitoring means is accomplished by a leak monitoring system as described and depicted in commonly assigned U.S. Pat. No. 3,995,472 issued on Dec. 7, 1976. Inspection vents 38 and 40 communicate with respective inspection boxes 76 and 78 for examination of the tank for leaks. The hose as utilized in connection with the detector system of the above referenced patent is shown as continuous hose 80 extending from inspection box 76 through space 42 between the shells of the tank and intercommunication with the other inspection box 78. Thus, when leakage of gas occurs through shell 24, it will be detected by hose 80 in the manner of the above described patent and the alarm will be activated.

Access is also provided through inspection vents 38 and 40 for a conventional pressure source to introduce air or other fluid for pressurizing the space 42 between the shells and an appropriate conventional gauge can be mounted above ground at the location of the inspection vents for monitoring the pressure. Thus, when a leak occurs through the outer shell 26 and the pressure in space 42 is reduced, it can be observed and monitored above ground. This type of dual leakage of monitoring system is feasible and compatible with the leak detector as disclosed in U.S. Pat. No. 3,995,472.

In summary, the installation of the present invention results in the following advantages. No workers need enter the excavation during installation. The sloped sides of the excavation minimize the possibility of collapse. The outer shell of the double shell tank will catch any liquid which leaks from the inner shell and trigger the alarm of the leak detecting device which is installed between the inner and outer shells of the tank. This signals any defect in the interior tank so that repairs can be made before any serious problem begins. The tank system is continuously monitored. Furthermore, by applying air pressure to the space between the tanks, it can be determined if there is any defect in the outer shell of the tank while the leak detection system signals any product leakage from the inner tank. The installation is of low cost with installation time being cut in half from the systems presently in use and greater safety and security is provided to the general public especially where tanks are located in residential communities.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A method of installing an underground storage tank comprising:

excavating to a predetermined depth sufficient for the placement of a storage tank of desired size therein below ground level with at least one pair of opposing side walls of the excavation being shaped to minimize the danger of collapse;

backfilling the excavation with a base layer of footing material;

placing a double shell storage tank into the excavation resting on the base layer;

installing double shell piping conduits and leak monitoring means between the shell and ground level;

backfilling the excavation with covering material over the tank, piping and monitoring means to a height adjacent ground level;

pouring a solid slab over the tank and backfill layers without closing access to the underground piping conduits and the monitoring means; and enabling the excavating, backfilling, placing of the tank, installing of piping and monitoring means and pouring of the slab to be accomplished without the necessity of personnel entering the excavation.

2. The invention in accordance with claim 1 wherein the backfill material is peastone gravel.

3. The invention in accordance with claim 1 wherein the sloped sides of the excavation have a 45° slope so as to minimize possibility of collapse of the excavation.

4. The invention in accordance with claim 1 wherein the slab placed over the tank is a reinforced concrete slab.

5. The invention in accordance with claim 1 wherein the installation is continuously monitored by said leak monitoring means.

6. The invention in accordance with claim 1 wherein the double shell storage tank is formed with the outer shell space from the inner shell so that the outer shell will catch any leakage from the inner shell and the leak monitoring means sensitive to leakage from the inner shell so as to be triggered thereby to signal any defect in the inner shell.

7. The invention in accordance with claim 1 wherein the double shell tank includes an outer shell spaced in surrounding relationship with an inner shell, air pressure means applying air pressure to the space between the tanks, the air pressure means determining any defect in the outer shell of the tank and the leak monitoring means detecting any leakage from the inner tank into space between the inner tank and the outer tank.

8. The invention in accordance with claim 1 wherein substantially immediately after placement of the storage tank into the excavation the tank is encased with covering material.

9. An underground storage tank installation comprising:

an excavation to a predetermined depth sufficient for the placement of a storage tank of desired size therein below ground level with at least one pair of opposing side walls of the excavation being sloped to minimize the danger of collapse;

a base layer of footing material backfilled into the excavation;

a double shell storage tank positioned in the excavation and resting on the base layer;

double shell piping conduits and leak monitoring means installed between the shell and ground level;

covering material in the excavation surrounding the tank and piping and monitoring means to a height adjacent ground level;

a solid slab positioned over the tank without closing access to the undersigned piping conduits and the leak monitoring means; and the excavation, filling material, positioning of the tank, piping and monitoring means installations, and positioning of the slab being accomplished without the necessity of personnel entering the excavation.

10. The invention in accordance with claim 9 wherein the base layer and surrounding material in the excavation is peastone gravel.

11. The invention in accordance with claim 9 wherein the slope of the sloped side walls of the excavation is 45°.

12. The invention in accordance with claim 9 wherein the top slab placed over the tank is of reinforced concrete.

13. The invention in accordance with claim 9 wherein the leak monitoring means continuously monitors the underground double walled tank system.

14. The invention in accordance with claim 9 wherein the outer shell of the double shell tank is spaced and in surrounding relationship to the inner shell so that any leakage from the inner tank will be captured between the inner and outer tank walls and the leak monitoring means will trigger an alarm.

15. The invention in accordance with claim 9 wherein pressure supply means apply air pressure to the space between the inner and outer tank and air pressure indicator means in communication therewith to determine if there is any defect in the outer shell wall and consequent reduction in pressure between the inner shell and the outer shell of the tank.

* * * * *